US009017088B2

(12) United States Patent
Endo et al.

(10) Patent No.: US 9,017,088 B2
(45) **Date of Patent: *Apr. 28, 2015**

(54) ELECTRIC CONNECTOR

(71) Applicant: Dai-Ichi Seiko Co., Ltd., Kyoto (JP)

(72) Inventors: Takayoshi Endo, Shizuoka (JP); Sakai Yagi, Shizuoka (JP); Jun Mukunoki, Shizuoka (JP); Shuji Touno, Shizuoka (JP)

(73) Assignee: Dai-Ichi Seiko Co., Ltd., Kyoto (JP)

( * ) Notice: Subject to any disclaimer, the term of this patent is extended or adjusted under 35 U.S.C. 154(b) by 267 days.

This patent is subject to a terminal disclaimer.

(21) Appl. No.: 13/706,449

(22) Filed: Dec. 6, 2012

(65) Prior Publication Data

US 2013/0149905 A1 Jun. 13, 2013

(30) Foreign Application Priority Data

Dec. 8, 2011 (JP) ..... 2011-269331

(51) Int. Cl.

*H01R 13/52* (2006.01)
*H01R 9/00* (2006.01)
*H01R 107/00* (2006.01)

(52) U.S. Cl.

CPC ..... *H01R 9/00* (2013.01); *H01R 13/52* (2013.01); *H01R 13/521* (2013.01); *H01R 2107/00* (2013.01)

(58) Field of Classification Search

CPC ..... H01R 13/5202; H01R 13/521; H01R 13/5216; H01R 13/5208; H01R 13/5219; H01R 13/5227; H01R 13/523; H01R 13/52

USPC ..... 439/736, 936, 937, 271, 272, 273, 274, 439/620.31, 646, 650, 606, 106, 107, 113, 439/119, 222, 227, 299, 30, 173, 652, 5, 439/578, 587, 604, 605, 77; 174/66, 67, 58

See application file for complete search history.

(56) References Cited

U.S. PATENT DOCUMENTS

| | | | | | |
|---|---|---|---|---|---|
| 5,574,819 | A * | 11/1996 | Gunther et al. | ..... | 385/139 |
| 5,588,885 | A * | 12/1996 | Gotz et al. | ..... | 439/876 |
| 6,149,456 | A * | 11/2000 | Uchiyama | ..... | 439/488 |
| 6,193,536 | B1 * | 2/2001 | Sanuki | ..... | 439/271 |
| 7,445,481 | B2 * | 11/2008 | Nagashima et al. | ..... | 439/276 |
| 8,814,606 | B2 * | 8/2014 | Endo et al. | ..... | 439/736 |

FOREIGN PATENT DOCUMENTS

| | | |
|---|---|---|
| JP | 2000-040551 | 2/2000 |
| JP | 2000-243504 | 9/2000 |
| JP | 2002-305065 | 10/2002 |
| JP | 2009-181798 | 8/2009 |
| JP | 2011-044253 | 3/2011 |
| WO | 2009/096367 | 8/2009 |

* cited by examiner

*Primary Examiner* — Renee Luebke
*Assistant Examiner* — Harshad Patel
(74) *Attorney, Agent, or Firm* — Wenderoth, Lind & Ponack, L.L.P.

(57) ABSTRACT

An electric connector includes a housing having an opening and a bottom. The housing has a recess formed at the bottom and at least one electric terminal projects through a bottom of the recess into the housing. A sealant layer composed of cured light-curing resin at least partially fills the recess.

20 Claims, 8 Drawing Sheets

TOTAL AMOUNT OF LIGHT AND REACTION RATE (%)

| | | TOTAL AMOUNT OF LIGHT (mJ/cm²) | | |
|---|---|---|---|---|
| | | 5000 | 10000 | 15000 |
| DEPTH (mm) | 1 | 62 | 92 | 100 |
| | 2 | 50 | 82 | 95 |
| | 3 | 40 | 70 | 90 |

ELECTRIC CONNECTOR

BACKGROUND OF THE INVENTION

1. Field of the Invention

The invention relates to an electric connector including a housing composed of an electrically insulating material, and a plurality of electric terminals composed of an electrically conductive material and housed in the housing.

2. Description of the Related Art

FIGS. 1 and 2 illustrate a conventional electric connector 70. The electric connector 70 includes a box-shaped housing 71 composed of an electrically insulating material, and a plurality of electric terminals 72 composed of an electrically conductive material. In order to prevent moisture from penetrating a gap formed between the housing 71 and the electric terminals 72, ultraviolet-curing resin 74 is filled entirely over a bottom 73 of the housing 71.

For instance, Japanese Patent Application Publication No. 2002-305065 has suggested a water-proof connector including rubber-like elastic material sealing a gap formed between wires connected to connector terminals, and holes through which the connector terminals are inserted, formed through a housing.

In the conventional electric connector 70 illustrated in FIGS. 1 and 2, since the ultraviolet-curing resin 74 used for fixing the electric terminals 72 is filled in the housing 71 so as to entirely cover the bottom 73 of the housing 71 therewith, it is necessary to prepare a lot of the ultraviolet-curing resin 74 in manufacturing the electric connector 70.

When ultraviolet rays are irradiated to the ultraviolet-curing resin 74 filled on the bottom 73 during the steps of manufacturing the electric connector 70, it is difficult for the ultraviolet rays to reach at a periphery of the bottom 73, that is, a boundary between the bottom 73 and a sidewall 75 of the housing 71, resulting in that the ultraviolet-curing resin 74 existing around the boundary is insufficiently cured.

In order to prevent the ultraviolet-curing resin 74 from being insufficiently cured, it is necessary for the ultraviolet-curing resin 74 to absorb ultraviolet rays in an increased amount. Accordingly, it is necessary to prepare a high-powered ultraviolet ray lamp, and it is also necessary for the lamp to irradiate ultraviolet rays in a long period of time, resulting in deterioration in a yield of manufacturing the electric connector 70.

In the water-proof connector suggested in the above-mentioned Publication, since the rubber-like elastic material, which corresponds to the ultraviolet-curing resin 74 in the electric connector 70, is filled in a gap formed between the wire connected to the connector terminal, and the through-hole through which the connector terminal is inserted and which is formed through the housing, a relatively small amount of the rubber-like elastic material is used. However, fluidic rubber has to be filled into each of the connector terminals through a dispenser with the result of complexity in manufacturing steps.

SUMMARY OF THE INVENTION

In view of the above-mentioned problems in the conventional electric connector, it is an object of the present invention to provide an electric connector which is capable of waterproofing a gap formed between an electric terminal and a housing, and reducing an amount of light-curing resin used for fixing electric terminals, without both complexity in steps of manufacturing an electric connector and reduction in a yield of manufacturing an electric connector.

It is further an object of the present invention to provide a housing suitable to such an electric connector.

In one aspect of the present invention, there is provided an electric connector including a housing having an opening and a bottom, the housing being formed at the bottom with a recess, at least one electric terminal projecting through a bottom of the recess into the housing, and a sealant layer composed of cured light-curing resin, the sealant layer at least partially filling the recess therewith.

The electric connector in accordance with the present invention is able to waterproof gaps formed between the housing and the electric terminals by curing light-curing resin filled in the recess, and further, reduce an amount of resin used for fixing the electric terminals, relative to a case in which light-curing resin is filled entirely on a bottom of the housing. Furthermore, since it is not necessary to change a step of filling light-curing resin, there is not brought complexity in steps of manufacturing the electric connector. In addition, since light-curing resin is not filled on a periphery of a bottom of the housing, at which it is difficult for lights for curing the light-curing resin to reach, it is no longer necessary to prepare a high-powered ultraviolet ray lamp, and it is also no longer necessary for the lamp to irradiate ultraviolet rays in a long period of time, avoiding deterioration in a yield of manufacturing the electric connector.

It is preferable that the recess, when vertically viewed, has a periphery defined by a continuous curve in a closed shape or a combination of a curve and a straight line.

By designing the recess to have such a periphery as mentioned above, when light-curing resin is filled in the recess in the steps of manufacturing the electric connector, it is possible to adequately fill light-curing resin around a periphery of the recess, and hence, possible to fill light-curing resin in the recess without gaps, ensuring enhancement in an adhesive force between the light-curing resin and the housing.

For instance, the periphery may be designed to be a rectangle with rounded corners.

For instance, the periphery may be designed to be substantially H-shaped.

It is preferable that the recess has an inclining sidewall.

By designing the recess to have an inclining sidewall, when light-curing resin is filled in the recess in the steps of manufacturing the electric connector, the inclining sidewall makes the light-curing resin have a gradually reducing thickness towards a periphery of the recess from a bottom of the recess. Accordingly, when lights are irradiated onto the light-curing resin for curing the light-curing resin, the lights can surely reach the light-curing resin existing around a periphery of the recess, ensuring that a reaction rate at which the light-curing resin is cured can be increased. Further, it is possible to enhance an adhesive force between the light-curing resin and the housing.

It is preferable that the inclining sidewall has a flat surface.

It is preferable that at least a part of the inclining sidewall is a projecting curved surface.

By designing at least a part of the inclining sidewall to be a projecting curved surface, it is possible to reduce a volume of the recess in comparison with a case in which the inclining the sidewall has a flat surface, and hence, possible to reduce an amount of the light-curing resin used for filling the recess. Further, it is also possible to increase an area in which the inclining sidewall of the recess makes contact with the light-curing resin in comparison with a case in which the inclining the sidewall has a flat surface, and hence, possible to enhance an adhesive force between the light-curing resin and the housing. Furthermore, it is possible to increase a rate at which a thickness of the light-curing resin filled in the recess is reduced towards a periphery of the recess from a bottom of the recess, ensuring enhancement an adhesive force between the light-curing resin and the housing.

It is preferable that at least a part of the inclining sidewall is continuously raised and recessed.

By designing at least a part of the inclining sidewall to be continuously raised and recessed, similarly to the above-mentioned case, it is possible to reduce a volume of the recess in comparison with a case in which the inclining sidewall has a flat surface, and hence, possible to reduce an amount of the light-curing resin used for filling the recess. Further, it is also possible to increase an area in which the inclining sidewall of the recess makes contact with the light-curing resin in comparison with a case in which the inclining the sidewall has a flat surface, and hence, possible to enhance an adhesive force between the light-curing resin and the housing. As an example of the inclining sidewall designed to be continuously raised and recessed, the inclining sidewall may be designed to be step-shaped.

It is preferable that each of steps has an inclining sidewall.

It is preferable that the recess has an area smaller than an area of the bottom of the housing when viewed vertically.

In another aspect of the present invention, there is provided a housing defining a part of an electric connector, the housing having an opening and a bottom and being formed at the bottom with a recess, the recess being formed at a bottom thereof with at least one through-hole through which an electric terminal is inserted such that the electric terminal projects into the housing, the recess being at least partially filled with cured light-curing resin.

The advantages obtained by the above-mentioned present invention will be described hereinbelow.

The electric connector in accordance with the present invention is able to cause gaps formed between electric terminals and a housing to be kept waterproof, and further, reduce an amount of light-curing resin to be filled in a recess for fixing the electric terminals, without complexity in steps of manufacturing the electric connector, and further without a fabrication yield of the electric connector.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

First Embodiment

The electric connector 100 in accordance with the first embodiment of the present invention is explained hereinbelow with reference to FIGS. 3 to 5.

Figure 1:
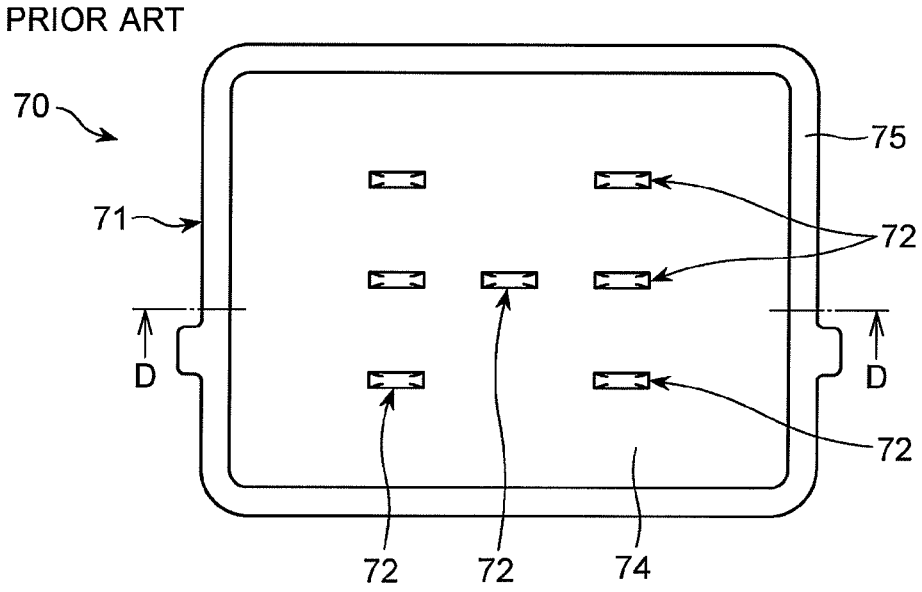
FIG. 1 is a plan view of a conventional electric connector.
Figure 2:
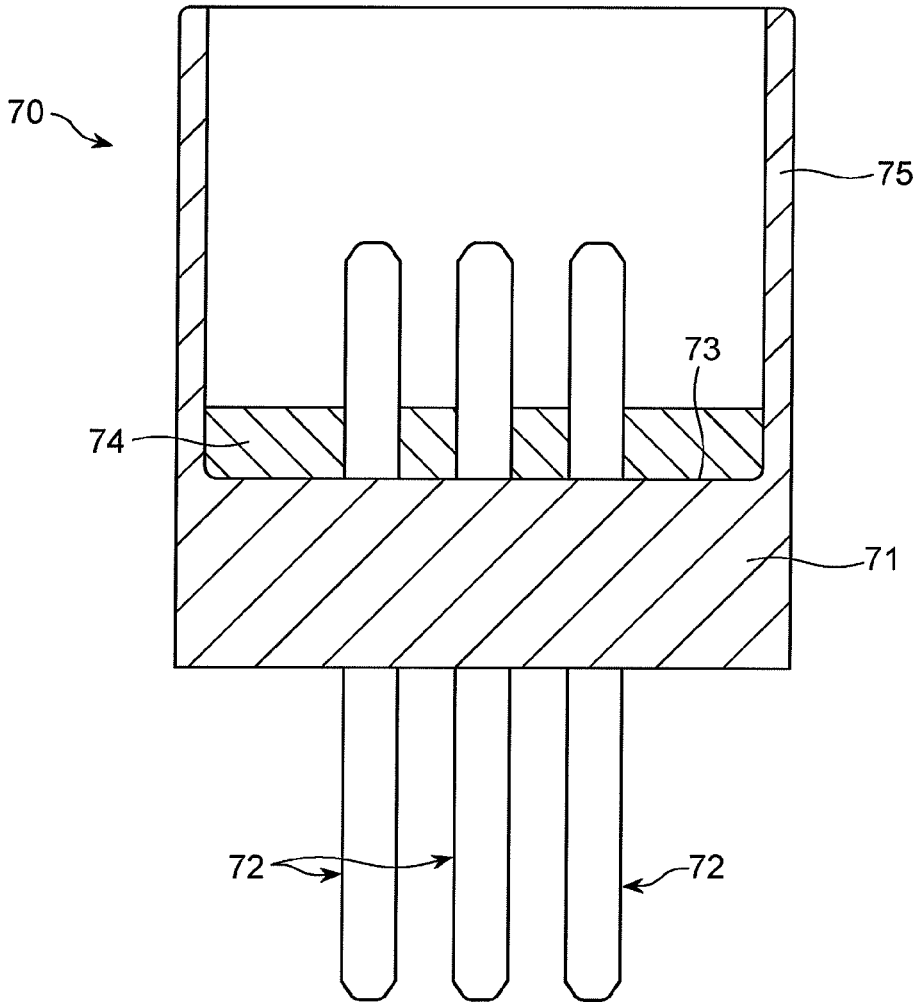
FIG. 2 PRIOR ART
FIG. 2 is a cross-sectional view taken along the line D-D in FIG. 1.
Figure 3:
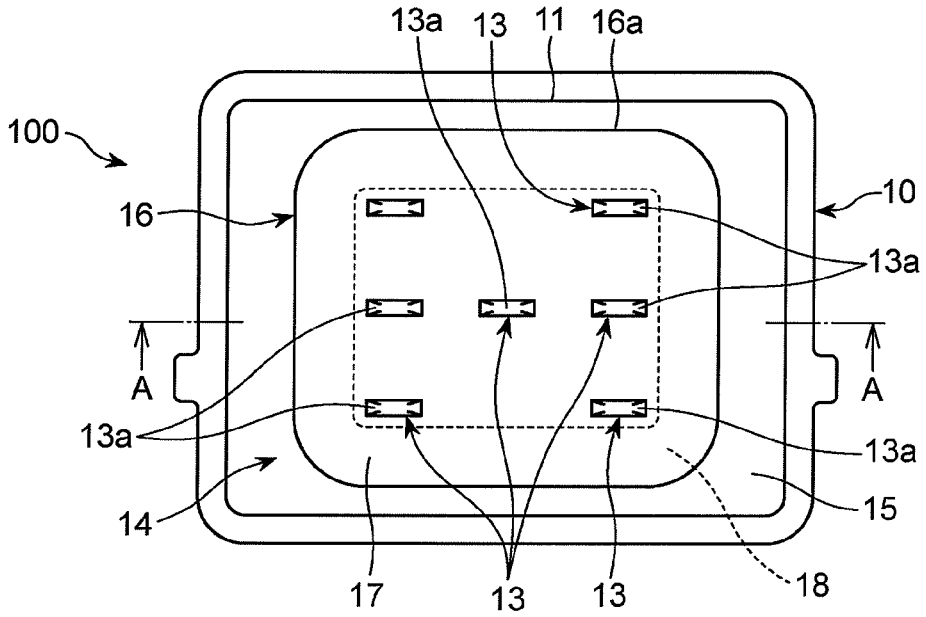
FIG. 3 is a plan view of the electric connector in accordance with the first embodiment of the present invention.
Figure 4:
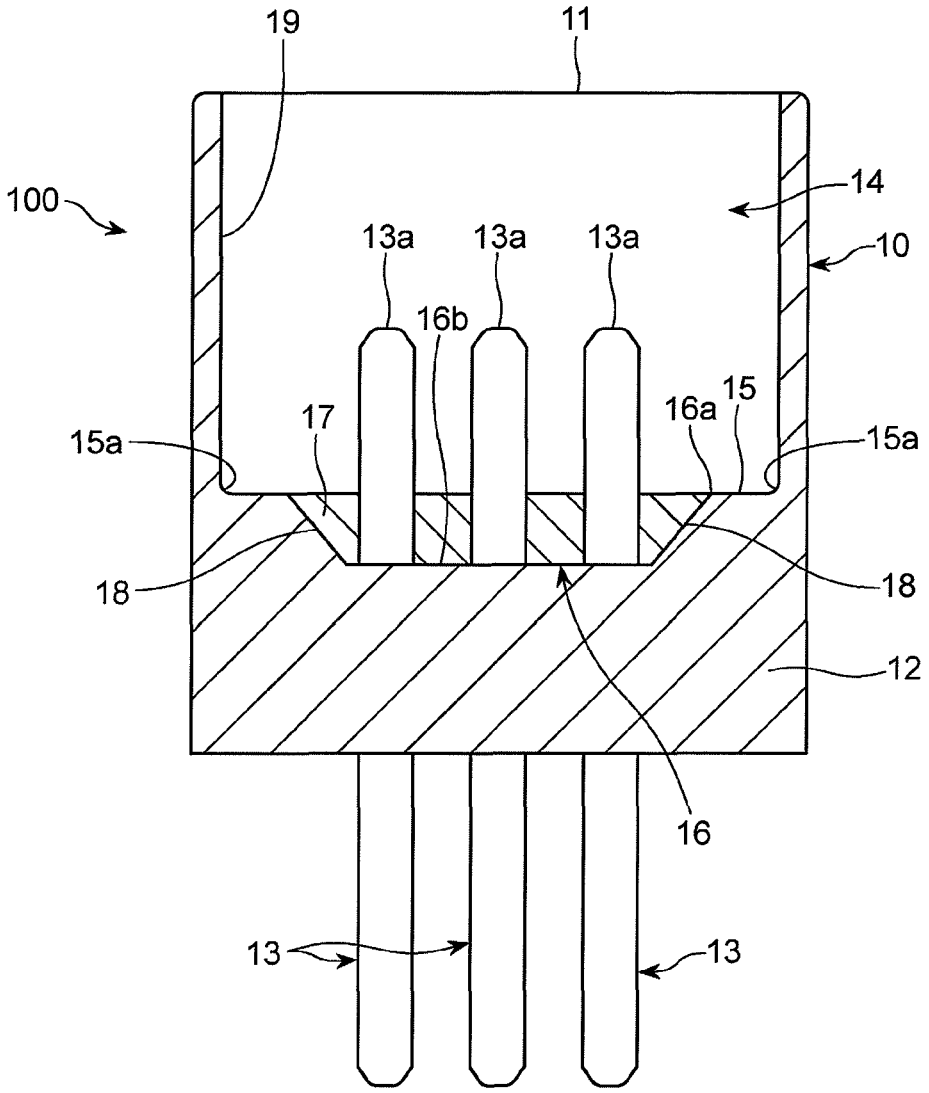
FIG. 4 is a cross-sectional view taken along the line A-A in FIG. 3.

As illustrated in FIGS. 3 and 4, the electric connector 100 includes a housing 10, a plurality of electric terminals 13, and a sealant layer 17.

The housing 10 has a substantially rectangular bottom 15, and a sidewall 19 vertically standing at a periphery of the bottom 15. An upper edge of the sidewall 19 defines an opening 11.

The housing 10 is formed at the bottom 15 with a recess 16. The recess 16 has an inclining sidewall 18, and hence, the recess 16 has a reverse-trapezoidal cross-section. The inclining sidewall 18 has a flat surface, and defines a depth of the recess 16 gradually reducing towards the sidewall 19 of the housing 10 from a bottom 16*b* of the recess 16.

The recess 16 has a smaller area than an area of the bottom 15 of the housing 10 when viewed vertically, as illustrated in FIG. 3. Accordingly, the bottom 15 of the housing 10 can be seen as a frame-shaped shelf only between a peripheral edge 16*a* of the recess 16 and the sidewall 19 of the housing 10.

The recess 16 is formed at the bottom 16*b* thereof with a plurality of through-holes through which the electric terminals 13 are inserted. Each of the through-holes pass through a bottom portion 12 of the housing 10, and has an elongated rectangular cross-section in line with a horizontal cross-section of the electric terminals 13.

Each of the electric terminals 13 is inserted into the through-hole such that a distal end 13*a* thereof projects beyond the bottom 15 of the housing 10 into an inner space 14 defined in the housing 10.

The sealant layer 17 is composed of light-curing resin filled in the recess 16. The sealant layer 17 seals the electric terminals 13 from the surroundings, that is, waterproofs gaps formed between the electric terminals 13 and the through-holes at the bottom of the recess 16.

As illustrated in FIG. 3, the peripheral edge 16*a* of the recess 16 is designed to have a closed shape defined by a combination of curves and straight lines, when viewed vertically. Specifically, the peripheral edge 16*a* is rectangular in shape with rounded corners.

In the steps of manufacturing the electric connector 100, the light-curing resin can be filled in the recess 16 by dispensing the light-curing resin into the recess 16 only once through the use of a dispenser (not illustrated), and hence, it is not necessary to change a conventional step of filling the recess with the light-curing resin, resulting in bringing no complexity in the manufacturing steps. Furthermore, since the light-curing resin is not filled at a peripheral edge 15*a* of the bottom 15 of the housing 10 at which ultraviolet rays for curing the light-curing resin are difficult to reach, it is not necessary to prepare a high-power ultraviolet ray lump, and to irradiate ultraviolet rays onto the light-curing resin for a long time, with the result of no reduction in a yield of fabricating the electric connector 100.

In addition, since the peripheral edge 16*a* of the recess 16 is designed to have a shape defined by a combination of curves and straight lines, when viewed vertically, when the light-curing resin is filled in the recess 16 in the steps of manufacturing the electric connector 100, it is possible to adequately fill the light-curing resin around the peripheral edge 16*a* of the recess 16, and hence, possible to fill the light-curing resin in the recess 16 without gaps, ensuring enhancement in an adhesive force between the light-curing resin and the housing 10.

The sealant layer 17 in the first embodiment is designed to have a thickness (depth) from the bottom 16*b* of the recess 16 to the upper edge 16*a* of the inclining sidewall 18. It should be noted that the sealant layer 17 may be designed to have a thickness smaller than a height of the inclining sidewall 18, if the sealant layer 17 can sufficiently seal the electric terminals 13 from the surroundings, and a sufficient adhesive force can be given between the sealant layer 17 and the recess 16, in which case, an amount of the light-curing resin to be filled in the recess 16 can be reduced in comparison with a case in which the recess 16 is entirely filled with the light-curing resin.

In the first embodiment, the sealant layer 17 filled in the recess 16 is designed to have a thickness of about 3 mm at a center thereof.

As the light-curing resin to be filled in the recess 16, there may be used a resin which can be cured by a curing-light, for instance, a visible light or an invisible light such as a ultraviolet ray and an infra-red ray. In the first embodiment, there is used a resin which is cured when ultraviolet rays are irradiated thereto, as mentioned earlier.

Hereinbelow is explained a relation between a reaction rate of the light-curing resin in dependence on a total amount of a curing-light irradiated thereto, and a depth of the light-curing resin, with reference to FIG. 5.

Figures 5, 6:
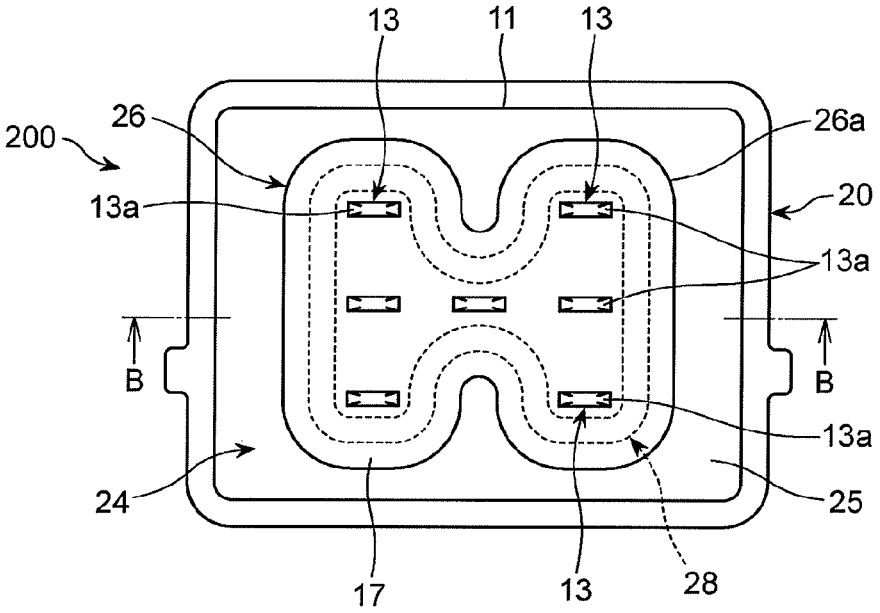
FIG. 5 is a table showing a relation between a reaction rate of light-curing resin in dependence on a total amount of a light irradiated thereto, and a depth of the light-curing resin.
FIG. 6 is a plan view of the electric connector in accordance with the second embodiment of the present invention.

The table shown in FIG. 5 indicates the reaction taken by the three light-curing resins each having a thickness of 1 mm, 2 mm and 3 mm when cured by curing-lights irradiated from a high pressure mercury lamp. The reaction was measured by a Fourier transform infrared spectrophotometer (FTIS).

As shown in FIG. 5, there was obtained a reaction rate of 100% to a depth of 1 mm when a total amount of curing-lights was 15,000 mJ/cm$^2$. Similarly, there were obtained reaction rates of 95% and 90% to depths of 2 mm and 3 mm, respectively, when a total amount of curing-lights was 15,000 mJ/cm$^2$.

When a total amount of curing-lights was 10,000 mJ/cm$^2$, there were obtained reaction rates of 92%, 82% and 70% to depths of 1 mm, 2 mm and 3 mm, respectively.

When a total amount of curing-lights was 5,000 mJ/cm$^2$, there were obtained reaction rates of 62%, 50% and 40% to depths of 1 mm, 2 mm and 3 mm, respectively.

In light of the above-mentioned measurement results, it is understood that light-curing resin having a smaller depth can be cured in a shorter period of time on the assumption that the same total amount of curing-lights is irradiated to light-curing resins.

Since the inclining sidewall 18 of the recess 16 upwardly inclines towards the sidewall 19 of the housing 10 from a center of the recess 16, a depth of the recess 16 gradually decreases towards the peripheral edge 16*a* of the recess 16 from the bottom 16*b* of the recess 16. Thus, a thickness of the light-curing resin filled in the recess 16 gradually decreases towards the peripheral edge 16*a*. As a result, a curing-light can reach the recess 16 by a shorter distance at a location closer to the peripheral edge 16*a* of the recess 16. Accordingly, since the light-curing resin of which the sealant layer 17 is composed can be surely cured even at a location close to the peripheral edge 16*a* of the recess 16, it is possible to enhance an adhesive force acting between the light-curing resin and the housing 10.

Second Embodiment

The electric connector 200 in accordance with the second embodiment of the present invention is explained hereinbelow with reference to FIGS. 6 and 7. Parts or elements that correspond to those of the electric connector 100 illustrated in FIGS. 3 and 4 have been provided with the same reference numerals, and will not be explained.

Figure 7:
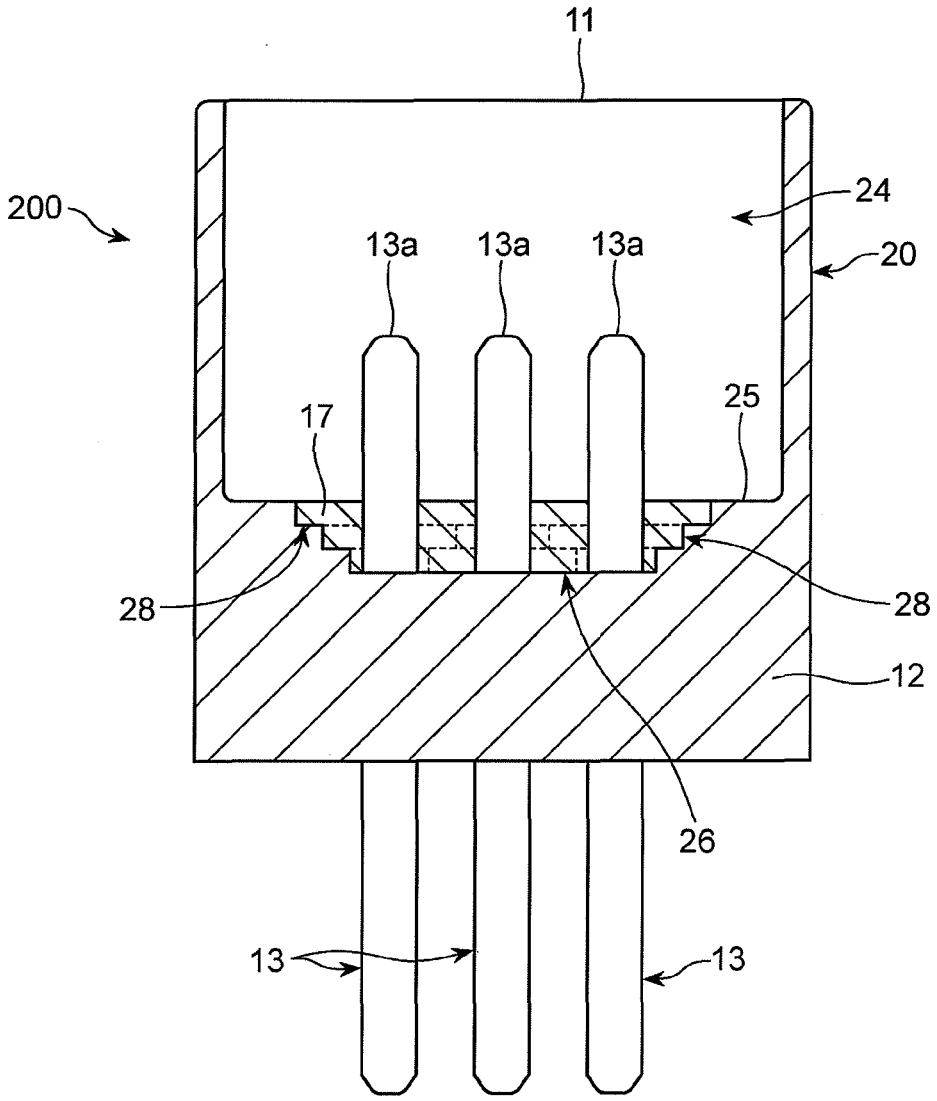
FIG. 7 is a cross-sectional view taken along the line B-B in FIG. 4.

As illustrated in FIGS. 6 and 7, the peripheral edge 26*a* of the recess 26 in the second embodiment is designed to have a shape defined by a combination of curves and straight lines. Specifically, a part of the peripheral edge 26*a* is inwardly recessed such that the recess 26 is substantially H-shaped, when viewed vertically. By designing the recess 26 to have the above-mentioned shape, it is possible for the recess 26 to have a volume smaller than a volume of the recess 16 illustrated in FIG. 3, and hence, it is possible to reduce an amount of light-curing resin to be filled in the recess 26.

As illustrated in FIG. 7, the recess 26 in the electric connector 200 is designed to have a step-shaped inclining sidewall 28. Since the recess 26 including a step-shaped inclining sidewall 28 can have a smaller volume than a volume of the recess 16 including the inclining sidewall 18 having a flat surface, illustrated in FIG. 4, it is possible to reduce an amount of light-curing resin to be filled in the recess 26.

In addition, since a reaction rate at which light-curing resin filled on the step-shaped inclining sidewall 28 is cured can be enhanced, it is possible to increase an adhesive force between the light-curing resin and the housing 20. Furthermore, the step-shaped inclining sidewall 28 increases an area at which the light-curing resin makes contact with the recess 26 in comparison with the inclining sidewall 18 having a flat surface (see FIG. 4), ensuring that an adhesive force between the light-curing resin and the recess 26 can be enhanced. The step-shaped inclining sidewall 28 has a thickness (a depth) starting from a bottom of the recess 26 and terminating at a bottom 25 of the housing 20, that is, an upper edge of the recess 26.

Part and functions thereof other than the above-mentioned ones are identical with those of the electric connector 100 in accordance with the first embodiment, illustrated in FIGS. 3 and 4.

Third Embodiment

The electric connector 300 in accordance with the third embodiment of the present invention is explained hereinbelow with reference to FIGS. 8 and 9. Parts or elements that correspond to those of the electric connector 100 illustrated in FIGS. 3 and 4 have been provided with the same reference numerals, and will not be explained.

Figure 8:
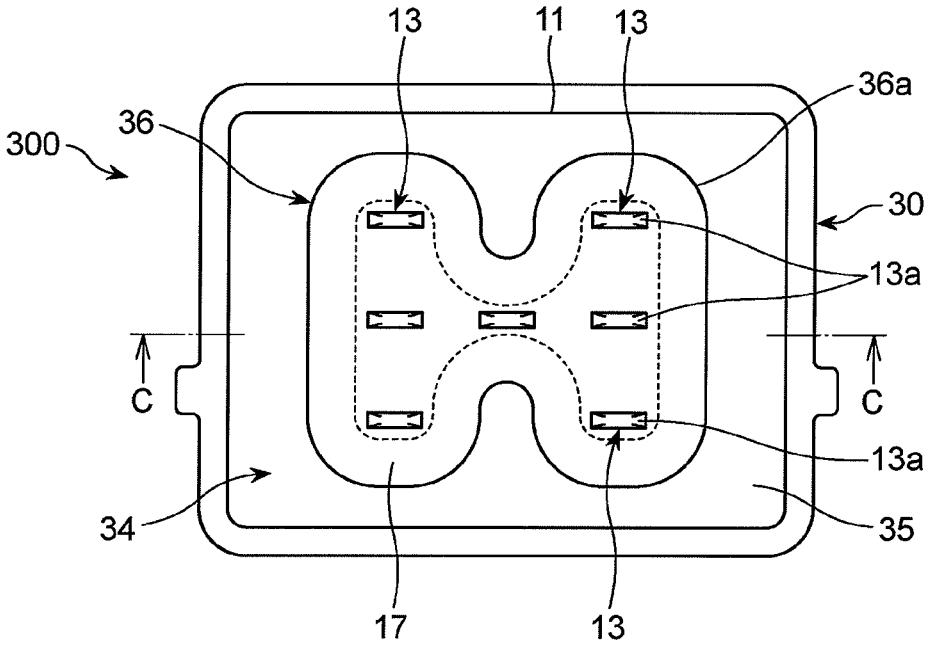
FIG. 8 is a plan view of the electric connector in accordance with the third embodiment of the present invention.
Figure 9:
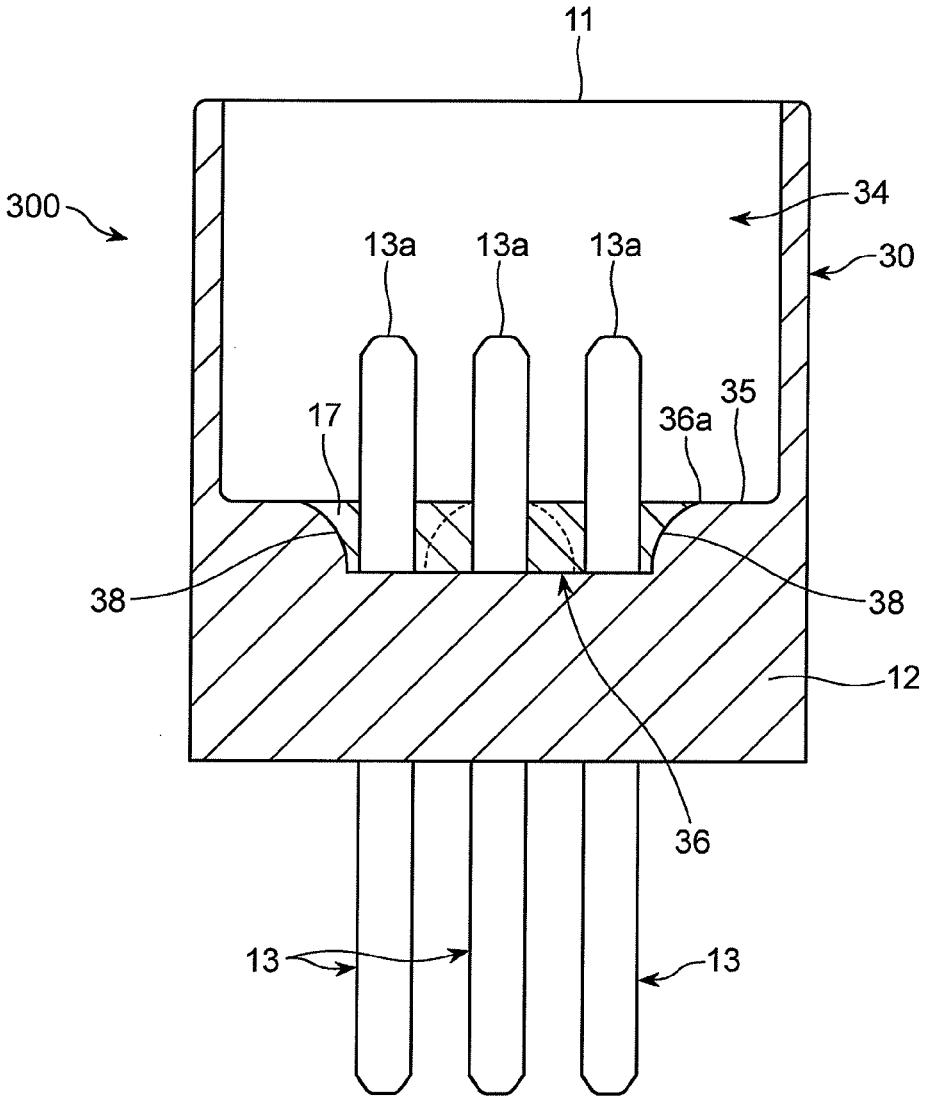
FIG. 9 is a cross-sectional view taken along the line C-C in FIG. 8.

As illustrated in FIGS. 8 and 9, the recess 36 formed at a bottom 35 of a housing 30 is designed to have a peripheral edge 36*a* defined by a combination of curves and straight lines, when viewed vertically. Specifically, a part of the peripheral edge 36*a* is inwardly recessed such that the recess 36 is substantially H-shaped, when viewed vertically. By designing the recess 36 to have the above-mentioned shape, it is possible for the recess 36 to have a volume smaller than a volume of the recess 16 illustrated in FIG. 3, and hence, it is possible to reduce an amount of light-curing resin to be filled in the recess 36.

As illustrated in FIG. 9, the recess 36 in the electric connector 300 is designed to have an inclining sidewall 38 having a projecting curved surface. Since the recess 36 including the inclining sidewall 38 having a projecting curved surface can have a smaller volume than a volume of the recess 16 including the inclining sidewall 18 having a flat surface, illustrated in FIG. 4, it is possible to reduce an amount of light-curing resin to be filled in the recess 36.

In addition, a thickness of the light-curing resin existing on the inclining sidewall 38 is made smaller at a location closer to a peripheral edge 36*a* of the recess 36, and hence, a reaction rate at which the light-curing resin filled on the inclining sidewall 38 is cured is enhanced. Thus, an adhesive force between the light-curing resin and the housing 30 can be kept stable, even if an amount of light irradiated to the light-curing resin is reduced to some degree. Furthermore, the inclining sidewall 38 having a projecting curved surface increases an area at which the light-curing resin makes contact with the recess 36 in comparison with the inclining sidewall 18 having a flat surface (see FIG. 4), ensuring that an adhesive force between the light-curing resin and the recess 36 can be enhanced. The inclining sidewall 38 has a thickness (a depth) starting from a bottom of the recess 36 and terminating at a bottom 35 of the housing 30, that is, an upper edge of the recess 36.

Part and functions thereof other than the above-mentioned ones are identical with those of the electric connector 100 in accordance with the first embodiment, illustrated in FIGS. 3 and 4.

The above-mentioned electric connectors 100, 200 and 300 are just exemplary embodiments of the present invention, and thus, the electric connector in accordance with the present invention is not to be limited to the electric connectors 100, 200 and 300.

INDUSTRIAL APPLICABILITY

The electric connector in accordance with the present invention can be used in fields of automobile industry and electronic/electric device industry, as a part of electronic and electric devices or as a part of electric wires to be equipped in an automobile.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

The entire disclosure of Japanese Patent Application No. 2011-269331 filed on Dec. 8, 2011 including specification, claims, drawings and summary is incorporated herein by reference in its entirety.

What is claimed is:

1. An electric connector comprising:

a housing having an opening and a bottom, said housing having a recess formed at said bottom;

at least one electric terminal projecting through a bottom of said recess into said housing; and a sealant layer composed of cured photo-curing resin, said sealant layer at least partially filling said recess therewith;

wherein said recess has an inclining sidewall, and at least a part of said inclining sidewall has a projecting curved surface.

2. The electric connector as set forth in claim 1, wherein said recess, when vertically viewed, has a periphery defined by a continuous curve in a closed shape or a combination of a curve and a straight line.

3. The electric connector as set forth in claim 2, wherein said periphery is a rectangle with rounded corners.

4. The electric connector as set forth in claim 2, wherein said periphery is substantially H-shaped.

5. The electric connector as set forth in claim 1, wherein said recess has an area smaller than an area of said bottom of said housing when viewed vertically.

6. An electric connector comprising:

a housing having an opening and a bottom, said housing having a recess formed at said bottom;

at least one electric terminal projecting through a bottom of said recess into said housing; and a sealant layer composed of cured photo-curing resin, said sealant layer at least partially filling said recess;

wherein said recess has an inclining sidewall, and at least a part of said inclining sidewall is continuously raised and recessed.

7. The electric connector as set forth in claim 6, wherein said recess, when vertically viewed, has a periphery defined by a continuous curve in a closed shape or a combination of a curve and a straight line.

8. The electric connector as set forth in claim 7, wherein said periphery is a rectangle with rounded corners.

9. The electric connector as set forth in claim 7, wherein said periphery is substantially H-shaped.

10. The electric connector as set forth in claim 6, wherein said recess has an area smaller than an area of said bottom of said housing when viewed vertically.

11. A housing defining a part of an electric connector, said housing comprising an opening and a bottom, and a recess is formed at said bottom;

wherein said recess is formed at said bottom with at least one through-hole through which an electric terminal is to be inserted such that said electric terminal projects into said housing;

wherein said recess is to be at least partially filled with cured photo-curing resin;

wherein said recess has an inclining sidewall, and at least a part of said inclining sidewall has a projecting curved surface.

12. The housing as set forth in claim 11, wherein said recess, when vertically viewed, has a periphery defined by a continuous curve in a closed shape or a combination of a curve and a straight line.

13. The housing as set forth in claim 12, wherein said periphery is a rectangle with rounded corners.

14. The housing as set forth in claim 12, wherein said periphery is substantially H-shaped.

15. The housing as set forth in claim 11, wherein said recess has an area smaller than an area of said bottom of said housing when viewed vertically.

16. A housing defining a part of an electric connector, wherein said housing comprising an opening and a bottom, and a recess is formed at said bottom;

wherein said recess is formed at said bottom with at least one through-hole through which an electric terminal is to be inserted such that said electric terminal projects into said housing;

wherein said recess is to be at least partially filled with cured photo-curing resin;

wherein said recess has an inclining sidewall, and at least a part of said inclining sidewall is continuously raised and recessed.

17. The housing as set forth in claim 16, wherein said recess, when vertically viewed, has a periphery defined by a continuous curve in a closed shape or a combination of a curve and a straight line.

18. The housing as set forth in claim 17, wherein said periphery is a rectangle with rounded corners.

19. The housing as set forth in claim 17, wherein said periphery is substantially H-shaped.

20. The housing as set forth in claim 16, wherein said recess has an area smaller than an area of said bottom of said housing when viewed vertically.

* * * * *